US011312143B2

(12) United States Patent
Studer et al.

(10) Patent No.: US 11,312,143 B2
(45) Date of Patent: Apr. 26, 2022

(54) FLUID INTERFACE DEVICE WITH SLIDING NEEDLE

(71) Applicant: Hewlett-Packard Development Company, L.P., Spring, TX (US)

(72) Inventors: Anthony D. Studer, Corvallis, OR (US); Robert S. Wickwire, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/616,481

(22) PCT Filed: Jul. 17, 2017

(86) PCT No.: PCT/US2017/042416
§ 371 (c)(1),
(2) Date: Nov. 24, 2019

(87) PCT Pub. No.: WO2019/017884
PCT Pub. Date: Jan. 24, 2019

(65) Prior Publication Data

US 2020/0171834 A1 Jun. 4, 2020

(51) Int. Cl.
*B41J 2/17* (2006.01)
*B41J 2/175* (2006.01)

(52) U.S. Cl.
CPC ..... *B41J 2/17513* (2013.01); *B41J 2/17523* (2013.01); *B41J 2/17509* (2013.01); *B41J 2/17546* (2013.01); *B41J 2002/17569* (2013.01); *B41J 2002/17573* (2013.01)

(58) Field of Classification Search
None
See application file for complete search history.

(56) References Cited

U.S. PATENT DOCUMENTS 5,715,833 A * 2/1998 Kleinhappl ..... A61B 5/15003 600/516
5,815,182 A * 9/1998 Otis ..... B41J 2/175 347/85
6,015,209 A 1/2000 Barinaga et al.
6,079,823 A 6/2000 Droege
7,300,138 B2 11/2007 Corner et al.
(Continued)

FOREIGN PATENT DOCUMENTS

EP 0778145 6/1999

OTHER PUBLICATIONS

Epson M Series B&W InkTank Printers, http://download.epson.com.sg/product_brochures/ink_tank_system/EPIL/epil_M100_M200_M105_M205.pdf?t=1.

*Primary Examiner* — Erica S Lin
(74) *Attorney, Agent, or Firm* — Fabian VanCott

(57) ABSTRACT

In one example in accordance with the present disclosure, a fluid interface device (106) is described. The device includes a collar (110) to receive a fluid container (104). The collar has an aperture in one end surface. A needle (108) of the fluid interface device passes through the aperture and allows fluid to pass from the fluid container (104) into a reservoir (102). The needle is slideable within the aperture from a dosed position to an open position upon reception of the fluid container. A seal (212) is radially disposed around the needle (108) and seals against the end surface of the collar (110) when the needle is in the dosed position.

20 Claims, 8 Drawing Sheets

(56) References Cited

U.S. PATENT DOCUMENTS

| | | | | |
|---|---|---|---|---|
| 7,543,920 | B2 | 6/2009 | Wilson et al. | |
| 9,623,664 | B2 | 4/2017 | Maeshima | |
| 2004/0027432 | A1* | 2/2004 | Childers | B41J 2/17513 347/86 |
| 2004/0183870 | A1 | 9/2004 | Steinmetz et al. | |
| 2007/0052740 | A1 | 3/2007 | Guhse et al. | |
| 2012/0008882 | A1 | 1/2012 | Justice et al. | |
| 2015/0359709 | A1* | 12/2015 | Kriheli | A61J 1/201 604/405 |
| 2016/0206511 | A1* | 7/2016 | Garfield | A61J 1/2003 |

* cited by examiner

FLUID INTERFACE DEVICE WITH SLIDING NEEDLE

BACKGROUND

Printers deposit a printing fluid on a surface to form printed images, text and/or other marks. That is, through a number of different mechanisms, printing fluid is drawn into a printer and placed on a substrate in a desired pattern. Printers come in varying types including electrophotographic printers and inkjet printers. The printing fluid used by these printers is supplied via a reservoir, which may deplete over time.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
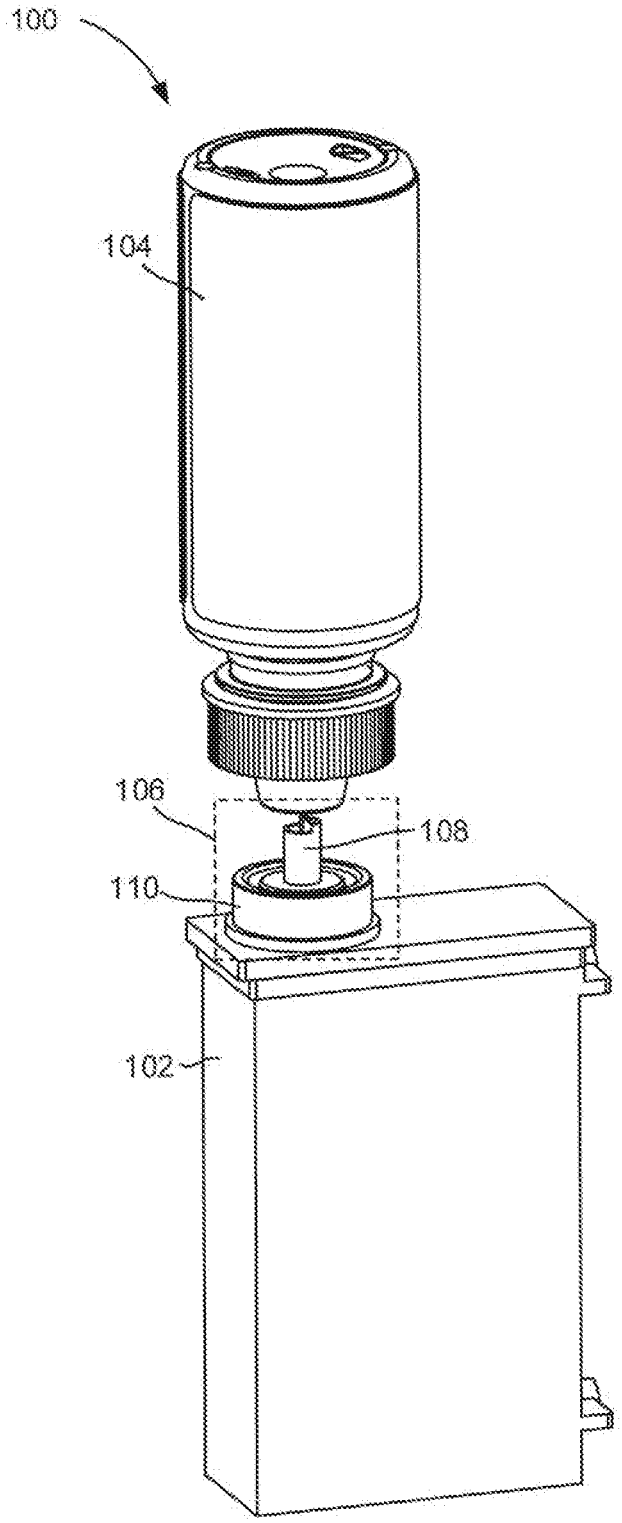
FIG. 1 is a diagram of a fluid transfer system that relies on a fluid interface device with a sliding needle, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Printers deposit a printing fluid on a surface to form printed images, text and/or other marks. That is, through a number of different mechanisms, printing fluid is drawn into a printer and placed on a substrate in a desired pattern. Printers come in varying types including electrophotographic printers and inkjet printers. The printing fluid used by these printers is supplied via a reservoir, which may deplete over time.

To facilitate additional printing, the fluid in the reservoir can be replaced with additional printing fluid. The additional printing fluid can come in a separate fluid container, which interfaces with the reservoir. The container mates with the reservoir and fluid can be transferred. The reservoir has a port, or interface, through which printing fluid in the fluid container transfers from the container to the reservoir for subsequent printing.

In some examples, the printer to which the reservoir is coupled is a sealed and/or pressurized system. That is, these printers are sealed and rely on pressure differentials to facilitate fluid transport throughout the printer. For example, the fluid delivery system of a printer may use mechanical or foam-based air admitting regulators in a printhead to control backpressure while printing. Pumps within the printer circulate fluid while recharging the system and/or to manage the air under the filter. Accordingly, the reservoir as well as the air/fluid return lines should be closed to protect the printhead.

Accordingly, the present specification describes a fluid interface device that selectively mates a fluid container containing printing fluid to a reservoir that is to receive the replacement printing fluid from the fluid container. The fluid interface device may be disposed on a surface of the reservoir.

The fluid interface device is biased to a closed position thus maintaining the seal and/or pressure within the printer when not engaged with a fluid container. However, upon refilling of the reservoir, i.e., upon selective mating of the fluid container and the reservoir, the fluid interface device is placed in an open position wherein fluid can flow freely from the fluid container to the reservoir.

The fluid interface device that includes a collar, and a needle within the collar. Prior to engagement with the fluid container, the interface is sealed such that fluid does not leak from the reservoir, and such that pressure and a seal are maintained at the fluid reservoir. As a fluid container is pressed onto the needle, the resulting force exposes passages in the needle to the interior of the reservoir such that fluid can pass to the reservoir from the fluid container. As the fluid container is removed following refill, the needle moves to the closed position to prevent fluid flow and maintain printer seals/pressure.

In one example, the present specification describes a fluid interface device. The fluid interface device includes a collar to receive a fluid container. The collar has an aperture in one end surface. A needle passes through the aperture and allows fluid to pass from the fluid container into a reservoir. The needle is slideable within the aperture from a closed position to an open position upon reception of the fluid container. A seal of the fluid interface device is radially disposed around the needle and seals against the end surface of the collar when the needle is in the closed position.

The present specification also describes a fluid interface device that includes the collar to receive a fluid container, the collar having an aperture in one end surface. A needle is collinear with the collar and passes through the aperture, to allow fluid to pass from the fluid container into a reservoir. In this example, the needle includes a first passage to allow fluid to flow from the fluid container into the reservoir and a second passage to allow air to flow from the reservoir into the fluid container. The needle is radially sealed against the aperture and is slideable within the aperture from a closed position, where openings in the first and second passages are blocked, to an open position, where the openings are open, upon reception of the fluid container. The needle is biased to the closed position. The fluid interface device includes a seal radially disposed around the needle to seal against the end surface of the collar when the needle is in the closed position.

The present specification also describes a fluid transfer system that includes a fluid container to contain fluid and a reservoir to selectively mate with, and receive fluid from, the fluid container. The fluid transfer system also includes a fluid interface device disposed on the reservoir. The fluid interface device includes a collar to receive the fluid container. A needle passes through an aperture in the collar to allow fluid to pass from the fluid container into a reservoir. The needle is slideable within the aperture from a closed position to an open position upon reception of the fluid container. The fluid interface device also includes a seal radially disposed around the needle to seal against the end surface of the collar when the needle is in the closed position.

In one example, using such a fluid interface device 1) provides an interface that is biased to a closed position such the fluid transfer system of the printer is maintained sealed and/or pressurized, 2) simplifies refill of a reservoir by a fluid container; 3) prevents overfilling of the reservoir; 4) prevents contamination of the fluid in the reservoir; 5) is robust against human error, 6) prevents fluid spillage when the reservoir is tipped; 7) alleviates the need for a reservoir cap; and 8) prevents fluid degradation via fluid evaporation. However, it is contemplated that the devices disclosed herein may address other matters and deficiencies in a number of technical areas.

As used in the present specification and in the appended claims, the term "open position" refers a position of the needle wherein fluid can transfer from the fluid container to the reservoir. For example, when in an open position, openings in the needle are exposed to an interior of the reservoir such that fluid can flow into the reservoir.

By comparison, the term "closed position" refers to a position of the needle wherein fluid does not transfer from the fluid container to the reservoir. In the closed position, the openings in the needle are blocked to the interior of the reservoir such that no fluid flows into the reservoir.

Further, as used in the present specification and in the appended claims, the term "a number of" or similar language is meant to be understood broadly as any positive number including 1 to infinity.

Turning now to the figures, FIG. 1 is a diagram of a fluid transfer system (100) that relies on a fluid interface device (106) with a sliding needle (108), according to an example of the principles described herein. The fluid transfer system (100) includes a reservoir (102) that holds fluid to be used by a printer. In one example, the fluid that is contained in the reservoir (102) is ink that is to be supplied to a printer. The printer draws fluid from the reservoir to form printed images and/or text on a media, or other, surface. The printer may use different types of mechanisms to form the printed images and/or text. For example, the printer may be an inkjet printer which uses nozzles and thermal ejectors to expel fluid onto a media surface in a particular pattern. In another example, the printer may be an electrophotographic printer which forms a latent image on a charged drum or belt in a particular pattern. Via electrostatic attraction, the ink is attracted to the latent image on the drum and subsequently transferred to the media surface. In these examples, the fluid delivery system implemented by the printer may be an off-axis system and may rely on pressure differentials to move fluid throughout the system.

As the printer is operated, i.e., as patterned images and/or text are formed on the media, fluid is depleted from the reservoir (102). The printing fluid is replenished from a fluid container (104) that contains additional printing fluid. As depicted in FIG. 1, fluid may transfer from the fluid container (104) to the reservoir (102) via gravity.

To receive the fluid, the reservoir (102), which selectively mates with the fluid container (104), includes a fluid interface device (106). The fluid interface device (105), prior to engagement with the fluid container (104), is in a closed position, meaning that fluid does not pass through. In other words, the fluid interface device (106) is biased to be in a dosed position. By biasing the fluid interface device (106) to a closed position, the seal of the fluid delivery system of the printer is maintained during operation, but can be opened, upon mating with the fluid container (104), to allow fluid to replenish the reservoir (102).

The fluid interface device (106) includes a collar (110) that receives the fluid container (104) and guides the fluid container (104) to proper alignment with the fluid interface device (106). That is, the collar (110) may have a cylindrical shape that receives a spout of the fluid container (104) and aligns the spout with the needle (108). The fluid interface (108) also has a needle (108) that passes through an aperture of the collar. That is, the collar (110) is open at one end to receive the fluid container (104) and at the other end has an aperture through which the needle (108) slides. The needle (108) is hollow and facilitates fluid flow from the fluid container (104) to the reservoir (102).

As described above, when in the closed position, no fluid flows through the fluid interface device (106). That is, on the inside of the reservoir (102), a seal of the fluid interface device (106) is adjacent the surface of the end surface of the collar (110) such that no fluid flows into the reservoir (102) when the needle (108) is in the closed position. However, as the fluid container (104) is mated with the fluid interface device (106), the needle (108) moves to expose openings on a portion of the needle (108) that is on the interior of the reservoir (102). With these openings exposed on the inside of the reservoir (102), fluid can flow down the needle (108), out through the openings of the needle (108), and into the reservoir (102).

The fluid transfer system (100) as described herein provides a self-sealing interface. That is, by no additional human interaction other than placing the fluid container (104) on and off of the reservoir (102), the fluid interface device (106) provides a seal/closed fluid delivery system when not engaged with a fluid container (104), but opens during refill to allow fluid flow from the fluid container (104) to the reservoir (102).

Figure 2:
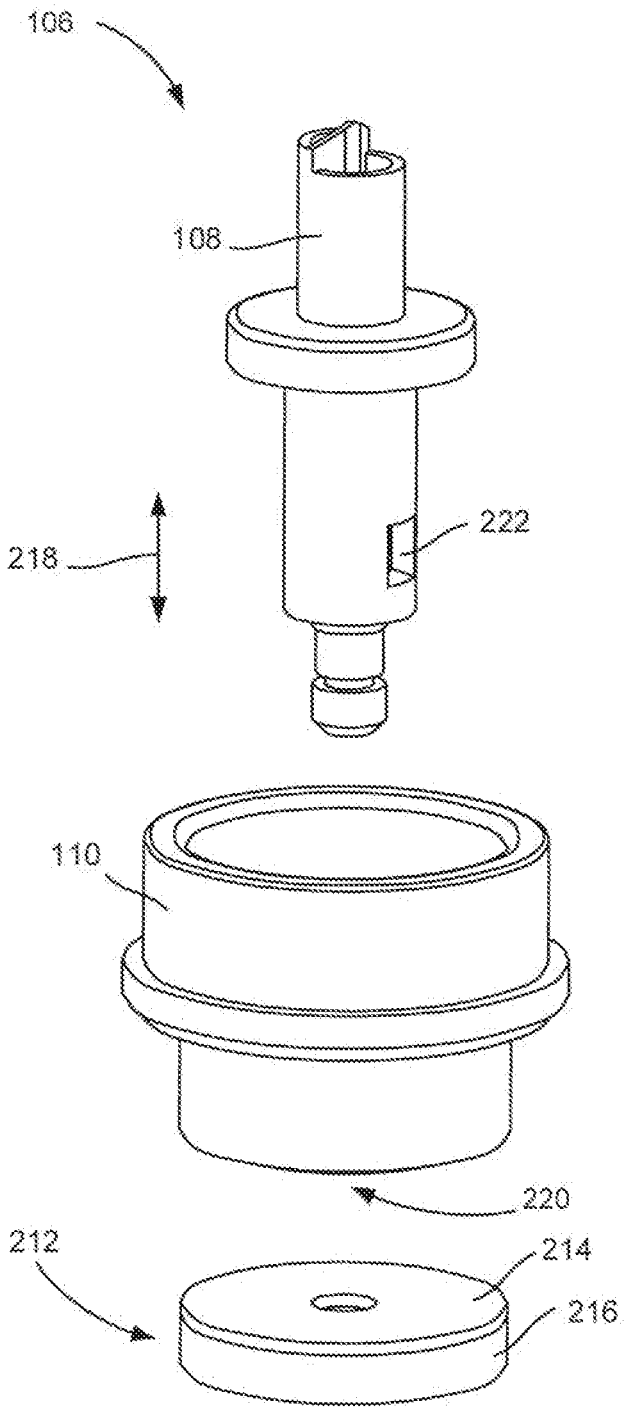
FIG. 2 is an exploded diagram of a fluid interface device with a sliding needle, according to an example of the principles described herein.

FIG. 2 is an exploded diagram of a fluid interface device (106) with a sliding needle (108), according to an example of the principles described herein. As noted, the fluid interface device (106) includes a collar (110). The collar (110) receives the fluid container (FIG. 1, 104) and aligns the fluid container (FIG. 1, 104) opening with the needle (108). The collar (110) has an aperture in an end surface (220). The needle (108) passes through this aperture and in some cases is radially sealed against the aperture. The needle (108) slides within this aperture between a closed position and an open position as indicated by the arrow (218).

When in the open position, openings (222) on the needle (108) are disposed on an interior of the reservoir (FIG. 1, 102) and allow fluid to pass from an interior of the hollow needle (108) into the reservoir (FIG. 1, 102). By comparison, when the needle (108) is in the closed position, the openings (222) are disposed within the collar (110), and the seal (212) is adjacent to, and seals against the end surface (220) of the collar (110). That is, the seal (212) is radially disposed around the needle (108) and seals against the end surface of the collar (110) when the needle (108) is in the closed position. The disposition of the openings (222) within the collar (110) and the juxtaposition, and compression of the seal (212) against the end surface (220) of the collar (11) prevent fluid flow to pass through the fluid interface device (106).

In some examples, the seal (212) is a two-material seal. Specifically, the seal (212) may include a deformable material (214) that is to contact, and seal against, the end surface (220) of the collar (110). A rigid material (216) is adjacent the deformable material (214) and provides the force that deforms the deformable material (214) against the end surface (220) of the collar (110).

Figure 3:
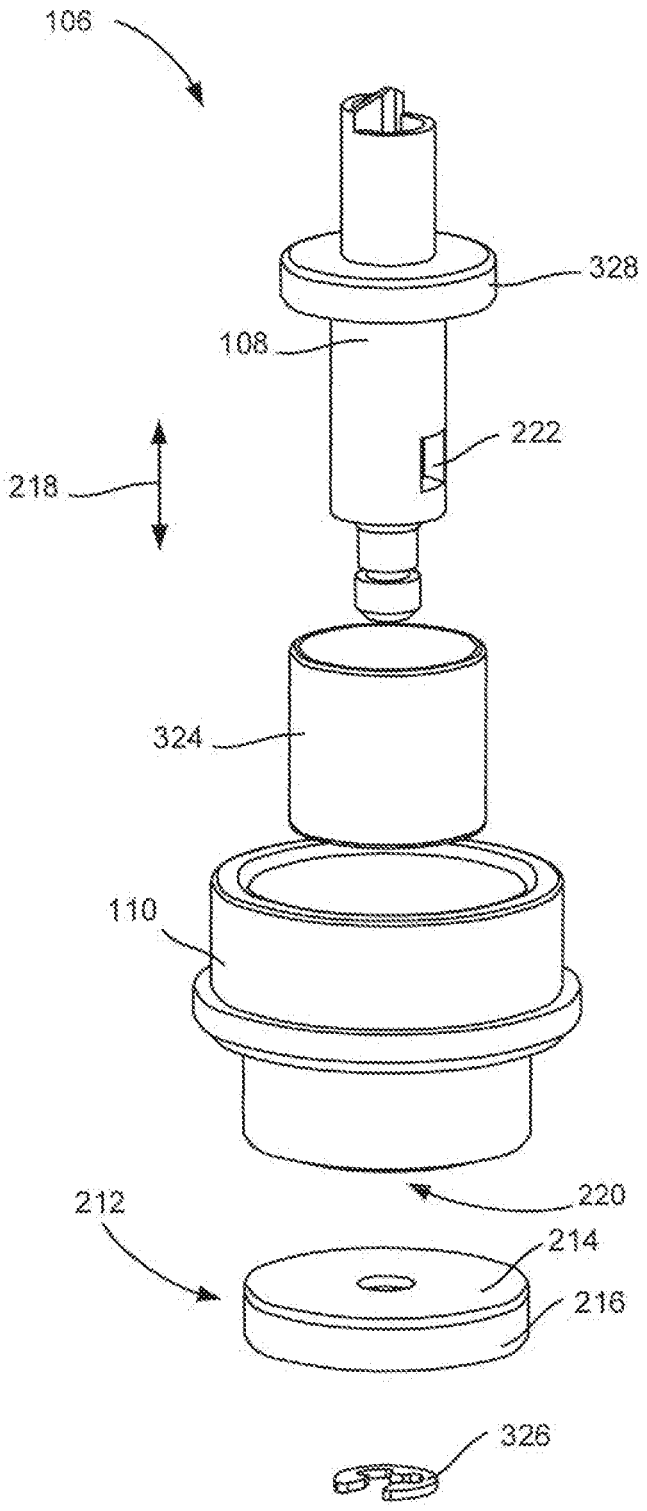
FIG. 3 is an exploded diagram of a fluid interface device with a sliding needle, according to another example of the principles described herein.

FIG. 3 is an exploded diagram of a fluid interface device (106) with a sliding needle (108), according to another example of the principles described herein. Specifically, FIG. 3 depicts the needle (108) with openings (222), collar (110), and seal (212) as described above in regards to FIG. 2.

FIG. 3 also depicts a representation of a spring (324) within the collar (110). As described above, the needle (108) is biased towards the closed position when not engaged with the fluid container (104). This biasing may be effectuated via the spring (324) disposed between the end surface of the collar and a protrusion (328) of the needle (108). When the spring (324) is at rest, it exerts a force on the needle (108) that places the seal (212) against the end surface (220) of the collar (110). The spring (324) may have such a force so as to deform the deformable material (214) of the seal (212) against raised protrusions of the end surface (220) of the collar (110). For example, the raised protrusion may include a ring, integrally formed on the collar (110) having a triangular cross-section. As described above, the seal may include a deformable material (214). This deformable material (214) when forced against the raised protrusion, deforms to create an effective seal.

FIG. 3 also depicts a retaining ring (326) that couples the seal (212) to the needle (108). That is, the seal (212) includes an aperture through which the needle (108) shaft passes and the retaining ring (326) clips to the needle (108) shaft such that the seal (212) is coupled to the needle (108) shaft.

Figure 4:
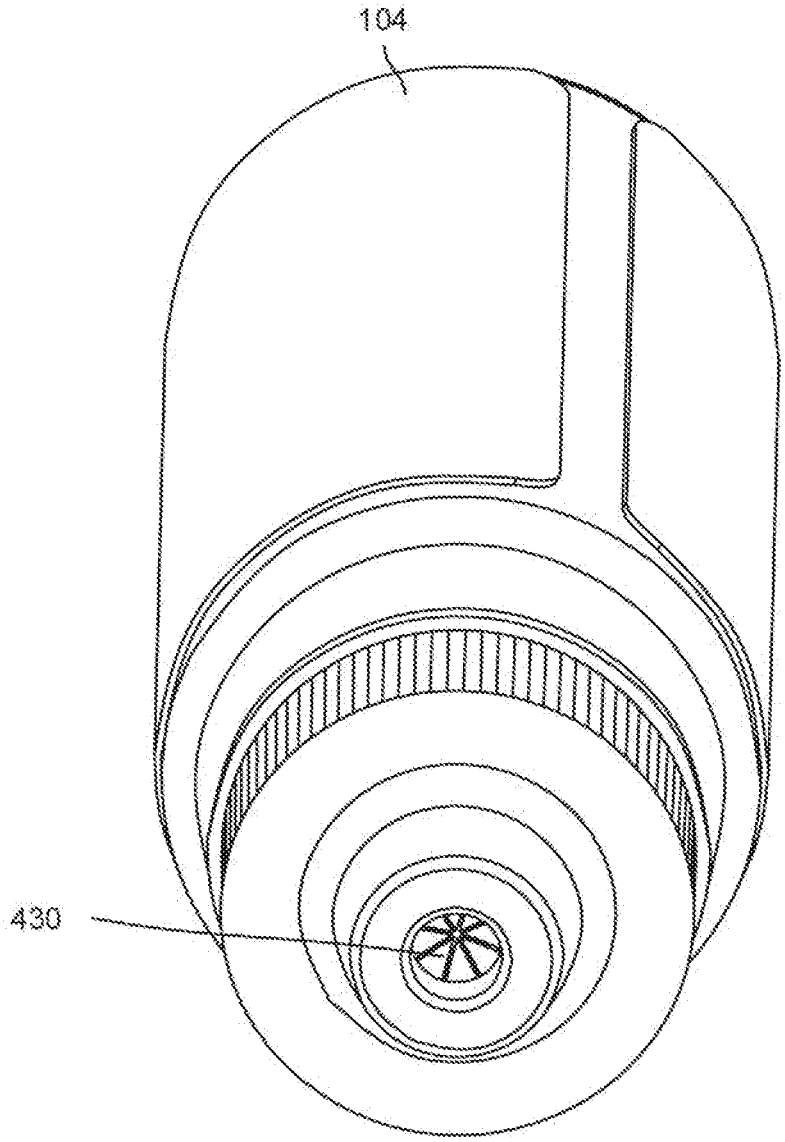
FIG. 4 is an isometric diagram of a fluid container to interface with the fluid interface device with a sliding needle, according to an example of the principles described herein.

FIG. 4 is an isometric diagram of a fluid container (104) to interface with the fluid interface device (FIG. 1, 106) with a sliding needle (FIG. 1, 108), according to an example of the principles described herein. In this example, the fluid container (104) includes a septum (430) that is breachable. That is, the septum (430) covers an opening of the fluid container (104) through which fluid flows. During refill, the needle (FIG. 1, 108) pierces the septum (430) to allow fluid to pass through the opening of the fluid container (104). In this example, the walls of the septum (430) seal against the shaft of the needle (FIG. 1, 108) during refill.

Following refill, the septum (430) restores to a leak-preventing state upon removal from the fluid interface device (FIG. 1, 106). That is, the walls of the septum (430) close to prevent the flow of fluid out of the fluid container (104). Accordingly, the septum (430) of the fluid container (104) 1) prevents spillage of the contents of the fluid container (104) when not engaged with a fluid interface device (FIG. 1, 106) and 2) upon piercing by the needle (FIG. 1, 108) during refill, allows the contents to flow from the fluid container (104) to the reservoir (FIG. 1, 102) without spilling.

Figure 5:
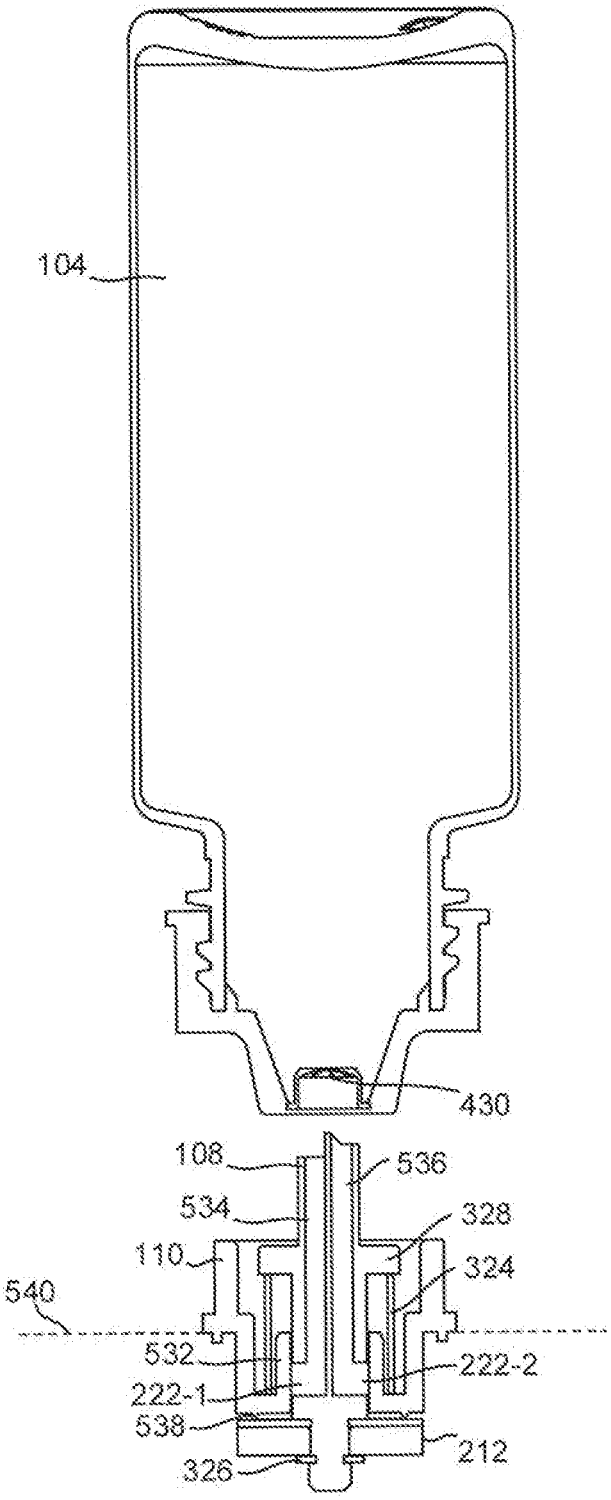
FIG. 5 is a cross-sectional diagram of a fluid container and fluid interface device prior to engagement according to an example of the principles described herein.

FIG. 5 is a cross-sectional diagram of a fluid container (104) and fluid interface device (FIG. 1, 106) prior to engagement, according to an example of the principles described herein. In FIG. 5, the surface of the reservoir (FIG. 1, 102) to which the fluid interface device (FIG. 1, 106) is disposed is indicated by the dashed line (540). That is, components below the dashed line (540) are within an interior of the reservoir (FIG. 1, 102) and components above the dashed line (540) are exterior to the reservoir (FIG. 1, 102).

As depicted in FIG. 5, the needle (108) is biased towards the closed position when not engaged with the fluid container (104) via the spring (324). That is, when the spring (324) is at rest, it exerts a force on the needle (108) that places the seal (212) against an end surface (FIG. 2, 220) of the collar (110). The spring (532) may have such a force so as to deform the deformable material (FIG. 2, 214) of the seal (212) against the raised protrusions (538) of the end surface (FIG. 2, 220) of the collar (110). For example, the raised protrusion (538) may include a ring, integrally formed on the collar (110) having a triangular cross-section. As described above, the seal may include a deformable material (FIG. 2, 214). This deformable material (FIG. 2, 214) when forced against the raised protrusion (538), deforms to create an effective seal.

A stop (532) in the collar (110) ensures that the needle (108) does not move past a desired open position. That is, in some examples, the needle (108) is biased in the closed position by the spring (324) disposed within the collar (110). If the needle (108) is moved such that the spring (324) is overcompressed, this may damage the spring (324), affecting the ability of the fluid interface device (106) to properly seal. In this example, as the needle (108) is moved from the closed position to the open position as depicted in FIG. 6, the stop (532) contacts a protrusion (328) of the needle (108) to stop the needle (108) from traveling past the open position.

Also, when in the closed position, the openings (222-1, 222-2) that allow fluid to flow through the needle (108) and into the reservoir (FIG. 1, 102) are disposed within, and sealed against, the collar (110) such that fluid cannot pass.

FIG. 5 also depicts various passages (534, 536) within the hollow needle (108). During refilling, one passage (534) allows fluid to flow out of the fluid container (104) and another passage (536) allows air to flow into the fluid container (104), which air flow allows fluid to pass out of the fluid container (104) as described in FIG. 6.

Figure 6:
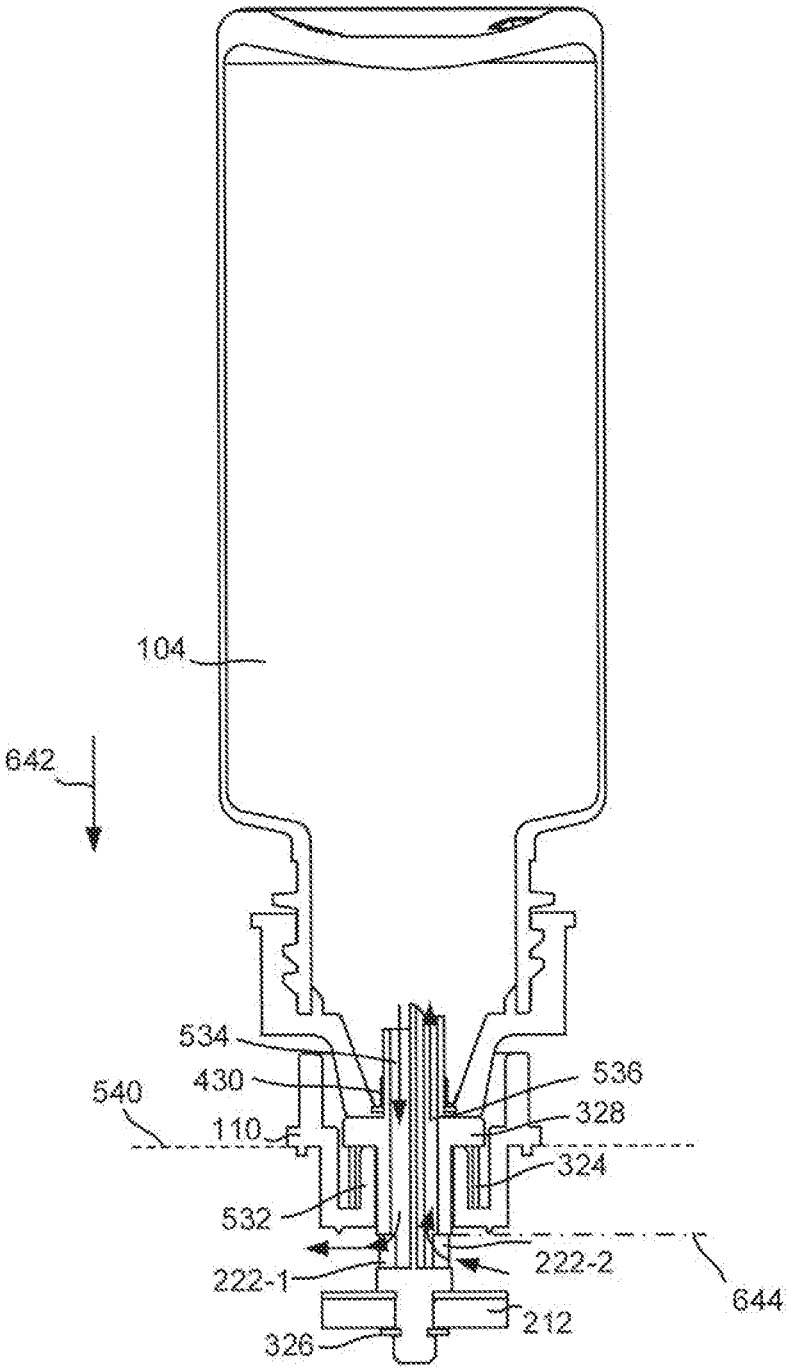
FIG. 6 is a cross-sectional diagram of a fluid container engaged with a fluid interface device, according to an example of the principles described herein.

FIG. 6 is a cross-sectional diagram of a fluid container (104) engaged with a fluid interface device (FIG. 1, 106), according to an example of the principles described herein. As in FIG. 5, the surface of the reservoir (FIG. 1, 102) to which the fluid interface device (FIG. 1, 106) is disposed is indicated by the dashed line (540) in FIG. 6. That is, components below the dashed line (540) are within an interior of the reservoir (FIG. 1, 102) and components above the dashed line (540) are exterior to the reservoir (FIG. 1, 102).

In FIG. 6, the fluid container (104) has been moved to engage with the fluid interface device (FIG. 1, 106). Specifically, the fluid container (104) has, by user manipulation been lowered onto the fluid interface (FIG. 1, 106) in the direction of the arrow (642).

In this process, the collar (110) has guided the fluid container (104) to properly align with the fluid interface device (FIG. 1, 106) such that the needle (108) pierces the septum (430). Further downward motion is prevented due to the interface between the stop (532) and the protrusion (328) on the needle (108). Preventing a certain amount of downward movement may be desirable to set an operating range for the fluid interface device (FIG. 1, 106). For example, further compression may damage the components of the fluid container (104), the reservoir (FIG. 1, 102), and/or the fluid interface device (FIG. 1, 106).

Responsive to this downward force, the needle (108) is placed in an open position. First, the needle (108) pierces the septum (430) such that the passages (534, 536) are in fluid communication with the fluid inside the fluid container (104). In this example, through a second passage (536), air passes from the reservoir (FIG. 1, 102) into the fluid container (104) thereby allowing fluid to pass through a first passage (534) from the fluid container (104) to the reservoir (FIG. 1, 102).

Also responsive to the downward force, the openings (222-1, 222-2) are exposed within the reservoir and the seal (212) is moved away from the end surface (FIG. 2, 220) of the collar allowing fluid to enter the reservoir (FIG. 1, 102). In some examples, the openings (222-1, 222-2) may be positioned to prevent overfill of the reservoir (FIG. 1, 102). That is, entry of air through the second passage (536) allows fluid to flow out of the first passage (534). During refilling, as the level of fluid passes the top of the second opening (222-2) as indicated by the dashed-dot line (644), air can no longer enter the fluid container (104) through the second passage (536). As air cannot enter, a vacuum within the fluid container (104) prevents additional fluid from flowing out the first passage (534). Accordingly, the interface as described herein ensures that a reservoir (FIG. 1, 102) will not be overfilled.

In summary, as depicted herein, the present fluid interface device (FIG. 1, 106) is biased towards a closed position as indicated in FIG. 5 so as to facilitate a sealed/pressurized fluid delivery system of the coupled printer. Upon refill, the needle (108) punctures a septum (430) and openings (222) in the needle (108) are exposed inside the reservoir (FIG. 1, 102) to allow fluid flow into the reservoir (FIG. 1, 102). After the reservoir (FIG. 1, 102) is refilled and the fluid container (104) removed, the spring (324) returns to its rest state and raises the needle (108) such that it is no longer in the open position. In this closed position, the seal (212) is positioned against the raised protrusions (FIG. 5, 538), and the openings (222) are again disposed within, and sealed against, the collar (110) wherein fluid cannot flow.

Figure 7A:
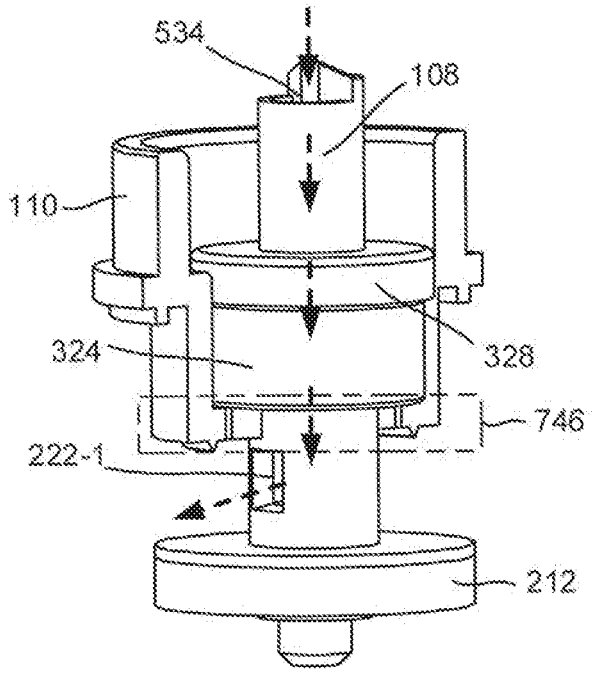
FIGS. 7A and 7B are cut-away diagrams of the fluid interface device with a sliding needle, according to an example of the principles described herein.
Figure 7B:
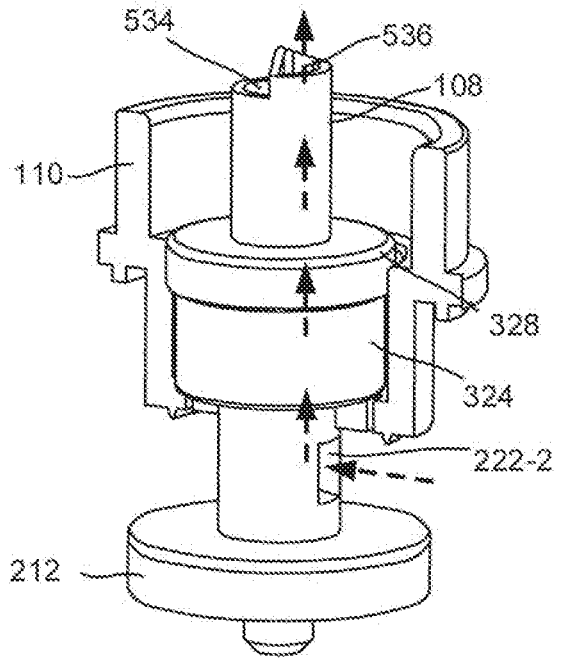

FIGS. 7A and 7B are cut-away diagrams of the fluid interface device (FIG. 1, 106) with sliding a sliding needle (108), according to an example of the principles described herein. Specifically, FIG. 7A is a diagram of the fluid interface device (FIG. 1, 106) in an open position to illustrate the fluid flow through the first passage (534) out the first opening (222-1) into the reservoir (FIG. 1, 102). To permit this fluid flow out of the fluid container (FIG. 1, 104), air passes into the fluid container (FIG. 1, 104) through the second opening (222-2).

Accordingly, FIG. 7B is a diagram of another side of the fluid interface device (FIG. 1, 106) in the open position illustrating the air flow out of the fluid reservoir (FIG. 1, 102) through the second opening (222-2) of the needle (108), through the second passage (536) and into the fluid container (FIG. 1, 104). Such a split-needle (108) structure facilitates efficient fluid flow by allowing air to enter the fluid container (FIG. 1, 104), without which the fluid would not be able to flow out of the fluid container (FIG. 1, 104).

Figure 8:
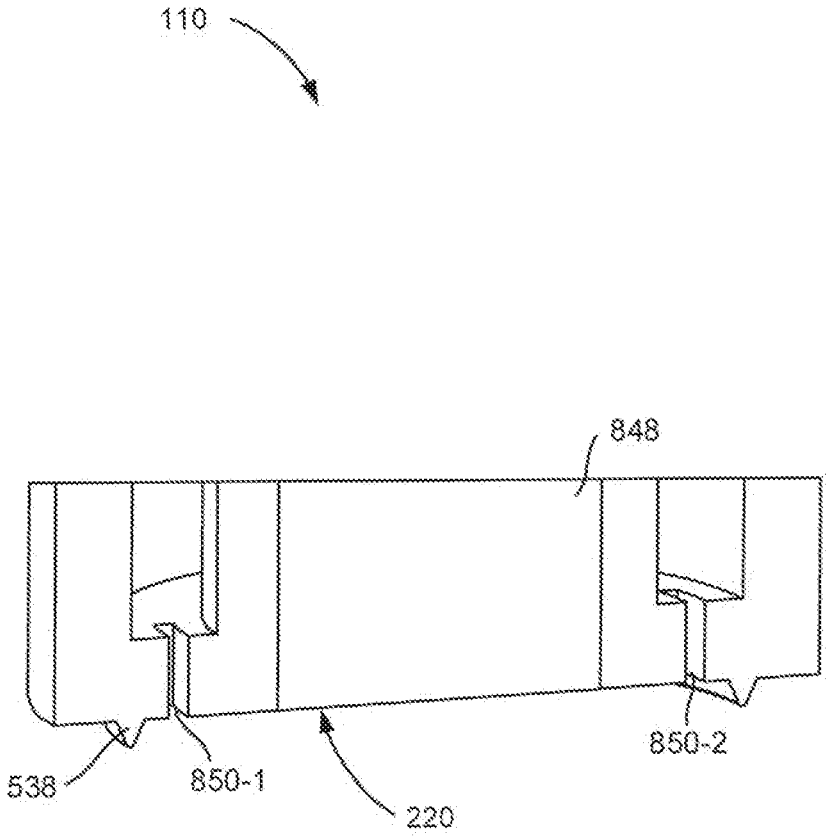
FIG. 8 is a zoomed in view of a portion of a collar of a fluid interface device with a sliding needle, according to an example of the principles described herein.

FIG. 8 is a zoomed in view of a portion of a collar (FIG. 1, 110) of a fluid interface device (FIG. 1, 106) with a sliding needle (FIG. 1, 108), according to an example of the principles described herein. Specifically, FIG. 8 is a zoomed-in portion of the area indicated by the box (746) in FIG. 7A. From this view, the raised protrusion (538) against which the deformable material (FIG. 2, 214) of the seal (FIG. 2, 212) is placed to create a seal is clearly depicted.

FIG. 8 also clearly depicts the aperture (848) in the collar (110) through which the needle (FIG. 1, 108) passes. In some examples, a number of channels (850-1, 850-2) are formed at the base of the collar (110). The channels (850) pass through the end surface (220) of the collar (110) and capture excess fluid flow when the needle (FIG. 1, 108) is in the open position. The channels (850-1, 850-2) allow the excess fluid to flow into the reservoir (FIG. 1, 102). For example, in the event that the septum (FIG. 4, 430) seal around the needle (FIG. 1, 108) does not entirely seal, excess fluid may drip out of the fluid container (FIG. 1, 104). This fluid is directed, by these channels (850-1, 850-2) to the fluid reservoir (FIG. 1, 102).

In one example, using such a fluid interface device 1) provides an interface that is biased to a closed position such the fluid transfer system of the printer is maintained sealed and/or pressurized, 2) simplifies refill of a reservoir by a fluid container; 3) prevents overfilling of the reservoir; 4) prevents contamination of the fluid in the reservoir; 5) is robust against human error, 6) prevents fluid spillage when the reservoir is tipped; 7) alleviates the need for a reservoir cap; and 8) prevents fluid degradation via fluid evaporation. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid interface device comprising:

a collar to receive a fluid container, the collar having an aperture in one end surface;

a needle passing through the aperture, to allow fluid to pass from the fluid container into a reservoir, wherein the needle is slideable within the aperture and moves relative to the collar from a closed position so that openings on the needle that are sealed in an interior of the reservoir are to move to an open position upon reception of the fluid container to expose the openings to the interior of the reservoir; and a seal radially disposed around the needle to seal against the end surface of the collar when the needle is in the closed position.

2. The device of claim 1, further comprising:

a first passage within the needle to allow fluid to flow from the fluid container into the reservoir; and a second passage within the needle to allow air to flow from the reservoir into the fluid container.

3. The device of claim 1, further comprising a spring disposed between the end surface of the collar and a protrusion on the needle to bias the needle to the closed position.

4. The device of claim 3, further comprising a stop disposed on the collar to engage the protrusion when the needle is in the open position.

5. The device of claim 1, wherein the needle is radially-sealed against the collar.

6. The device of claim 1, wherein the seal deforms against a raised protrusion on the end surface of the collar when the needle is in the closed position.

7. The device of claim 1, wherein the seal is a two-material seal comprising:

a deformable material to contact the end surface of the collar; and a rigid material adjacent the deformable material.

8. A fluid interface device comprising:

a collar to receive a fluid container, the collar having an aperture in one end surface;

a needle collinear with the collar and passing through the aperture, to allow fluid to pass from the fluid container into a reservoir;

a first passage within the needle to allow fluid to flow from the fluid container into the reservoir;

a second passage within the needle to allow air to flow from the reservoir into the fluid container, wherein:

the needle is radially sealed against the aperture;

the needle is slideable within the aperture and moves relative to the collar and reservoir from a closed position, where openings in the first and second passages are blocked within the collar in an interior of the reservoir, to an open position, where the openings in the first and second passages are exposed at the interior of the reservoir, upon reception of the fluid container; and the needle is biased to the closed position; and a seal radially disposed around the needle and in an interior of the reservoir to seal against the end surface of the collar when the needle is in the closed position.

9. The device of claim 8, wherein the openings are positioned on the needle to prevent overfill of the reservoir.

10. The device of claim 8, further comprising channels passing through the end surface of the collar to capture excess fluid flow when the needle is in the open position.

11. The device of claim 8, wherein the seal is biased, by a spring, to seal the reservoir when the needle is in the closed position.

12. A fluid transfer system comprising:

a fluid container to contain fluid;

a reservoir to receive the selectively mate with, and receive fluid from the fluid container; and a fluid interface disposed on the reservoir, the fluid interface comprising:

a collar to receive the fluid container;

a needle passing through an aperture in the collar to allow fluid to pass from the fluid container into a reservoir, wherein the needle is slideable within the aperture and moves relative to a stop on the collar and the reservoir from a closed position so that openings on the needle that are sealed within the collar in an interior of the reservoir are to move to an open position upon reception of the fluid container, wherein when in the open position openings in the needle are disposed on the interior of the reservoir;

a seal disposed on an inside of the reservoir and radially disposed around the needle to seal against the end surface of the collar when the needle is in the closed position, wherein the seal is moved away from the end surface of the collar upon reception of the fluid container.

13. The system of claim 12, wherein the reservoir is at least one of sealed and pressurized to facilitate fluid transport.

14. The system of claim 12, wherein the fluid container comprises a breachable septum covering an opening of the container to prevent fluid leak.

15. The system of claim 14, wherein the septum:

is pierced by the needle during installation; and restores to a leak-preventing state upon removal from the fluid interface device.

16. The device of claim 1, wherein, when in the closed position, openings in the needle to allow fluid to pass into the reservoir are disposed within the collar.

17. The device of claim 16, wherein, when in the closed position, the openings are sealed against the collar.

18. The device of claim 1, wherein, when in the open position, openings in the needle are exposed to a volume inside the reservoir.

19. The device of claim 1, wherein as the needle slides from the closed position to the open position, the seal is moved away from the end surface.

20. The device of claim 6, wherein the protrusion is a ring with a triangular cross-section.

* * * * *